United States Patent [19]

Haag et al.

[11] 4,031,693

[45] June 28, 1977

[54] ELECTRONIC DIGITAL CLOCKS

[75] Inventors: Albrecht Haag, Dauchingen; Helmut Stechmann, Schwenningen, both of Germany

[73] Assignee: Kienzle Uhrenfabriken GmbH, Schwenningen, Germany

[22] Filed: Dec. 23, 1975

[21] Appl. No.: 643,878

[30] Foreign Application Priority Data

Dec. 27, 1974 Germany ..... 2461563
Feb. 25, 1975 Germany ..... 2508037

[52] U.S. Cl. ..... 58/33; 58/50 R; 58/38 R

[51] Int. Cl.[2] ..... G04C 13/06

[58] Field of Search ..... 58/23 R, 38 R, 50 R, 58/152 B, 19 R, 57.5, 33; 340/173 SP

[56] References Cited

UNITED STATES PATENTS

| | | | |
|---|---|---|---|
| 3,664,116 | 5/1972 | Emerson et al. | 58/50 R X |
| 3,759,029 | 9/1973 | Komaki | 58/38 |
| 3,834,153 | 9/1974 | Yoda et al. | 58/57.5 X |
| 3,940,918 | 3/1976 | Everson | 58/38 R X |
| 3,940,919 | 3/1976 | Yasuda et al. | 58/38 R |
| 3,943,288 | 3/1976 | Reed et al. | 58/19 R X |
| 3,946,549 | 3/1976 | Cake | 58/38 R |

*Primary Examiner*—Ulysses Weldon
*Attorney, Agent, or Firm*—Pollock, VandeSande & Priddy

[57] ABSTRACT

An electronic digital clock includes an arbitrary number of fixed value stores the BCD stored values of which are compared with the BCD time representative signals generated by the clock to produce, in the event of coincidence, an electrical output signal which serves for switching purposes. In order to reduce the number of connections to be made to an integrated clock chip the clock may include a changeover switch which enables connections to the clock display device also to be used as connections to the stores.

32 Claims, 10 Drawing Figures

| | | 1 | 2 | 4 | 8 | |
|---|---|---|---|---|---|---|
| DAILY | 0 | | | | | ON |
| MON. | 1 | • | | | | |
| TUES. | 2 | | • | | | |
| WED. | 3 | • | • | | | |
| THURS. | 4 | | | • | | |
| FRI | 5 | • | | • | | |
| SAT. | 6 | | • | • | | |
| SUN. | 7 | • | • | • | | |
| | | | | | • | OFF |

ELECTRONIC DIGITAL CLOCKS

This invention relates to an electronic digital clock having at least one time-programmed electrical output for triggering switching functions.

Electronic clocks providing a digital display are known, in which a constant-frequency signal is applied to a clock circuit. The constant-frequency signal can be generated by a crystal or can be derived from the electrical mains supply. The clock circuit generates coded signals, usually BCD signals, usually BCD signals, which are applied to a display logic circuit. The display logic circuit in turn drives for example a seven segment display. The switching sequence of the coded signals and the display logic circuit is determined by a multiplexer which is supplied with pulses from the clock circuit. In this fashion, it is possible to provide an opto-electronic digital time display, which may for example include a display of the day of the week.

Time switches are known which have a time-programmed electrical output in order to trigger switching functions. The time-programming is performed mechanically by a timer disc which at a present time, which is determined mechanically, closes or opens switching contacts. In electronic digital equipment such an arrangement is not possible because no mechanical moving parts are present.

In electronic digital clocks it is, however, known to provide a time switching function. For this purpose, an electronic store is provided and, when the stored value corresponds with the time displayed by the clock, a signal triggering a switching function is generated. The store can consist of a decade counter pulsed by the clock circuit. A disadvantage of such an arrangement is the relatively high outlay in circuitry involved in the execution of just one switching function. A further disadvantage resides in the fact that in the event of any interruption in the current supply the store is erased and the information has to be restored into it.

This invention seeks to provide a clock in which at least the former disadvantage is reduced.

According to this invention there is provided an electronic digital clock having at least one time-programmed electrical output for triggering switching functions, the clock comprising a digital elecrical time display, a clock circuit for producing and applying to said display coded signals representing time, a multiplexer, at least one coded fixed-value store, a sampling logic circuit and a comparator circuit, wherein coded values stored in the fixed-value store are sampled under the control of the multiplexer by the sampling logic circuit and are compared in the comparator circuit with said coded signals representing time, and wherein in the event of coincidence between the sampled values and the coded signals representing time an output signal is produced at said time-programmed electrical output.

It is possible in this fashion to provide a virtually arbitrary number of stores without increasing the outlay in circuitry as a consequence of the number of stores. By using fixed-value stores which comprise coding switches, it is also possible to contrive that even after an interruption in the current supply, the stored value previously written in is retained un-disturbed. A further advantage resides in the fact that the stored values adjusted can be read out at any time, i.e. it is possible at any desired time to determine which store is set to which value.

The invention will be further understood from the following description by way of example of embodiments thereof with reference to the accompanying drawings, in which:

FIG. 1 shows a schematic circuit diagram of a clock in accordance with an embodiment of the invention and having two stores;

FIG. 2*a* shows a block schematic illustration of the circuit diagram of FIG. 1;

FIG. 2*b* shows a block schematic illustration of the circuit diagram of a clock which is similar to that shown in FIG. 1 but which has more than two stores;

FIG. 3*a* illustrates signals which occur in operation of the clock shown in FIGS. 1 and 2*a;*

FIG. 3*b* shows a logic table for the coding of days of the week for the clock shown in FIGS. 1 and 2*a;*

Figure 1:
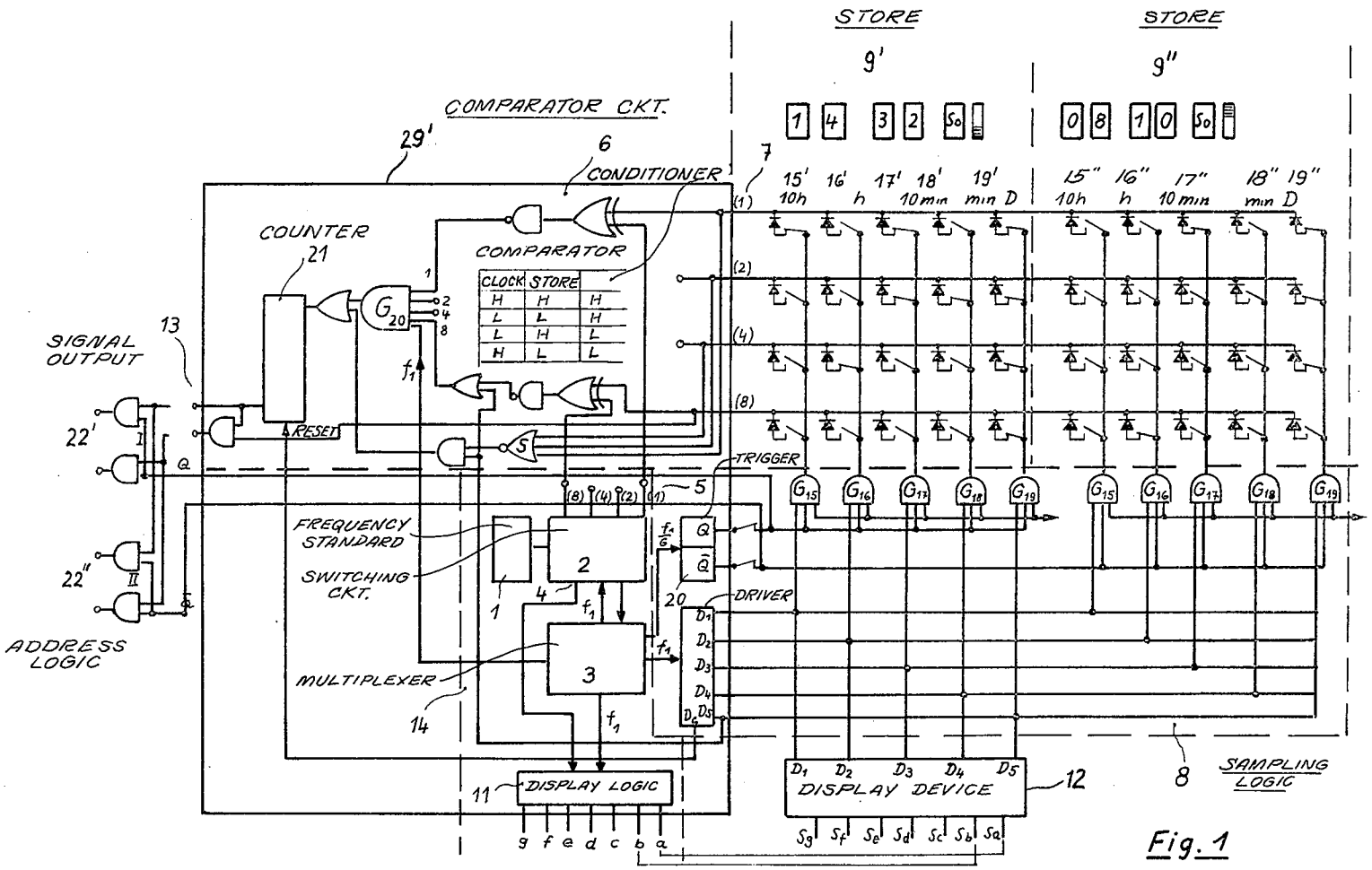
Figure 4:
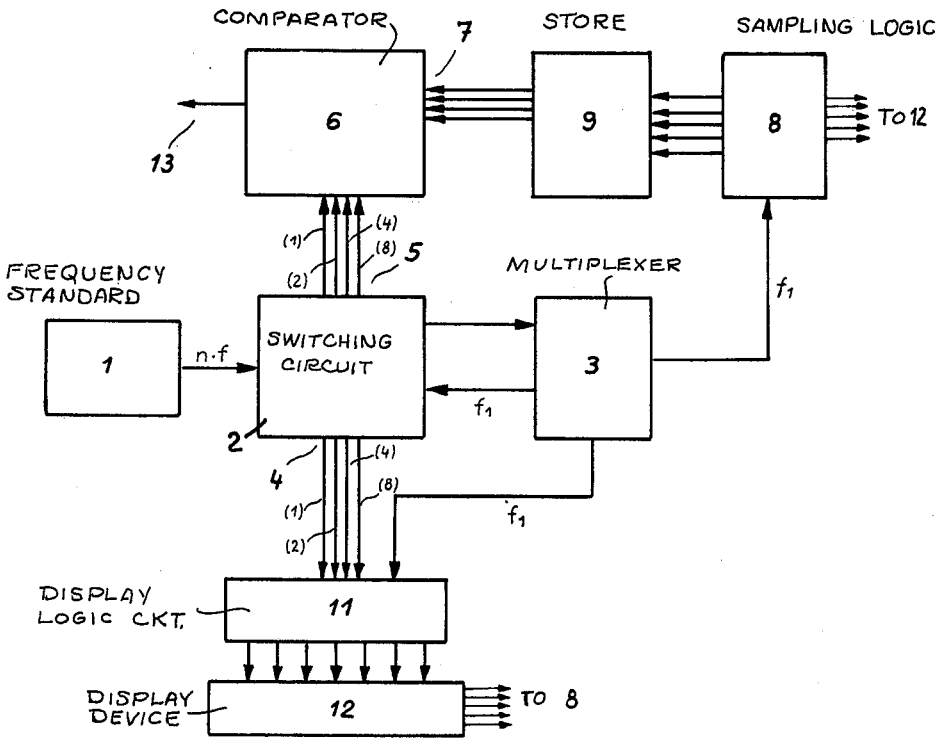
FIG. 4 shows a block circuit diagram of the clock shown in FIGS. 1 and 2*a;*

Referring to the drawings, in FIGS. 1 and 4 a block 1 represents a frequency standard, which may be a crystal-controlled oscillator or the normal AC mains. Pulses from the frequency standard are applied to a clock switching circuit 2. The clock circuit 2 produces at an output 4 binary coded decimal (BCD) signals which are applied to a display logic circuit 11 which is connected to a display device 12, for example a seven segment display. The clock circuit 2 also supplies pulses to a multiplexer 3 which in turn determines a switching sequence of the coded signals at the output 4 and the display logic circuit 11. Between the output 4 and the display logic circuit 11 there are four individual lines (1), (2), (4) and (8) for the BCD signals, as is known per se. The elements 1, 2, 3 and 11 are shown in FIG. 1 within a block 14. If the frequency standard 1 is a crystal-controlled oscillator, the clock is preferably battery powered. If the frequency standard 1 is the normal AC-mains, however, the clock is preferably powered from these AC-mains.

The multiplexer 3 has a further output which is connected to a sampling logic device 8. A frequency $f_1$ produced at this further output is the same as the frequency produced at the multiplexer outputs which are connected to the display logic circuit 11 and the clock 2.

The sampling logic device 8 successively samples the individual decades of BCD fixed-value (read-only) stores 9 (9' and 9'' in FIG. 1). The sampled stored values are applied to a BCD input 7 of a comparator circuit 6. The comparator circuit 6 has a further BCD input which is connected to a BCD output 5 of the clock circuit 2. If the stored values coincide with the BCD output signal appearing at the output 5 of the clock circuit 2, then the comparator circuit 6 applies a signal to an output 13. The stores 9 are coded BCD fixed-value stores. These stores operate with switching contacts and the coded input can be effected through the medium of digital reels, coded cards for insertion into a reader, punched cards, punched tapes and other fixed-value data carriers. Instead of switching contacts, other switching elements can be provided. Each store is subdivided into decades. In the illustration example, each store 9 has five decades, namely a decade 15 for tens of hours, a decade 16 for units of hours, a decade 17 for tens of minutes, a decade 18 for units of minutes, and a decade 19 for the day of the week and an on/off switching function.

Figure 7:
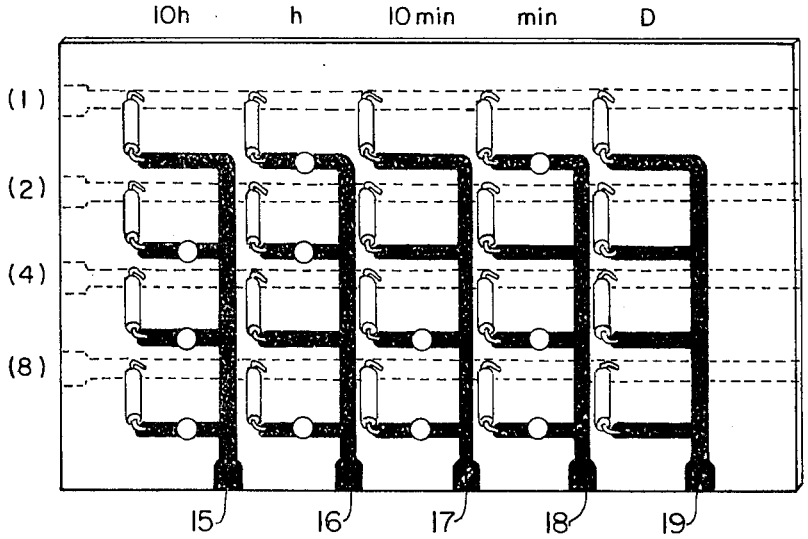
FIG. 7 illustrates a data carrier in the form of a punched card used as a fixed-value store.

A data carrier of current or tape type in the form of a punched card is illustrated in FIG. 7 for use as a fixed value store 9. The tapes are punched or perforated according to the switches (on/off) of the decades of store 9′ in FIG. 1.

Figure 8:
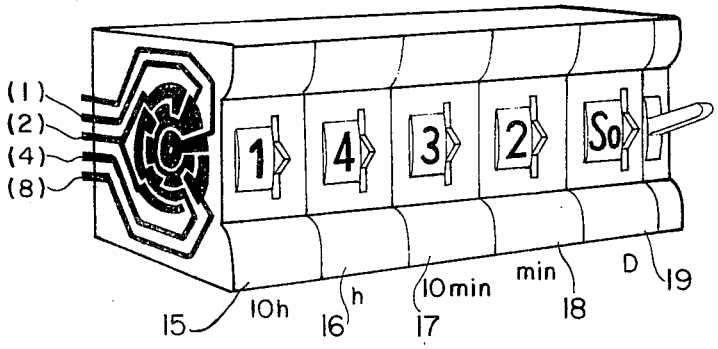
FIG. 8 illustrates a fixed-value store in the form of coding switches.

The fixed-value store 9′ according to FIG. 1 can further be constituted by coding switches of the type shown in FIG. 8, having reels divided into decades, namely a decade 15 for tens of hours, a decade 16 for units of hours, a decade 17 for tens of minutes, a decade 18 for units of minutes, a decade 19 for the day of the week, and an on/off switch.

Figure 2A:
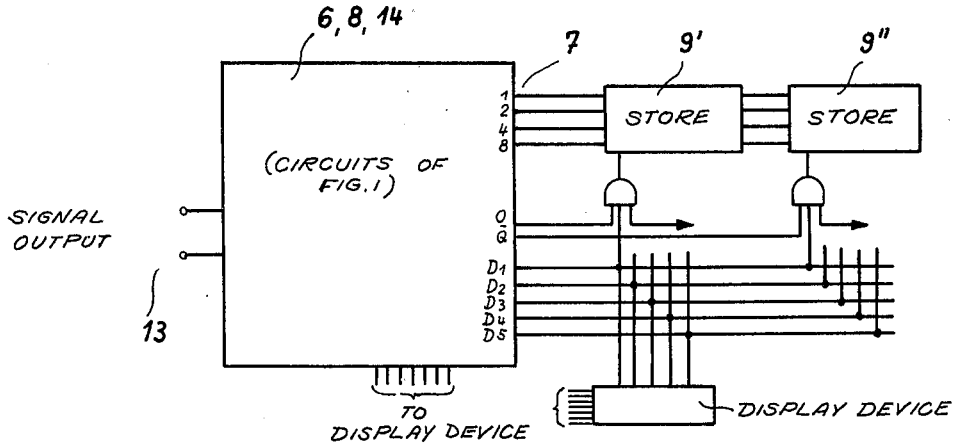
Figure 2B:
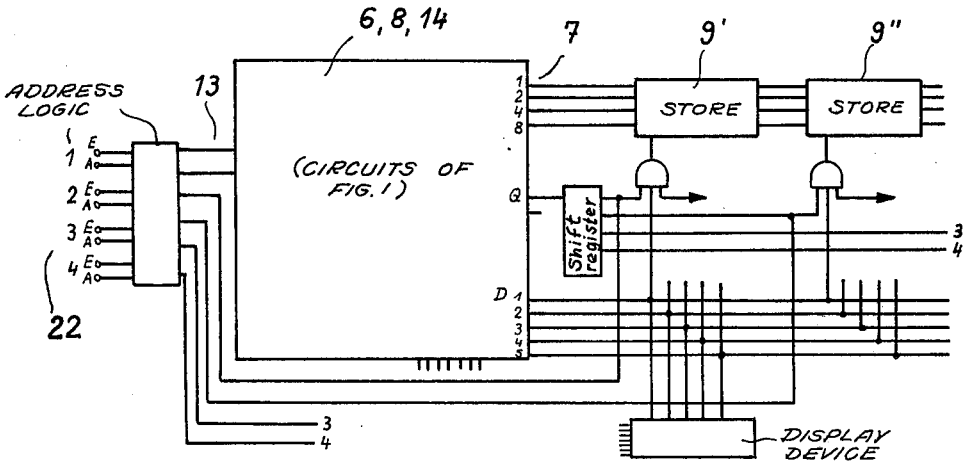

The individual stores 9 and their decades are sampled as follows: the multiplexer 3 supplies pulses to a digit driver having outputs $D_1$ to $D_6$ at the frequency $f_1$. The driver output $D_1$ is connected to an input of each of gates $G_{15}$ which are associated with the decades 15 of all the stores 9. The same applies to the driver outputs $D_2$ to $D_5$ in relation to gates $G_{16}$ to $G_{19}$ respectively. On the occasion of a first sampling pulse of sampling frequency $f_1$ (see FIG. 3*a*) a pulse is supplied to all the gates $G_{15}$, on the occurrence of a second sampling pulse, via the driver output $D_2$, all the gates $G_{16}$ are supplied with a pulse, and so on until after a fifth sampling pulse. Another input of all the gates $G_{15}$ to $G_{19}$ associated with each store is connected to an output of a bistable trigger stage (in the case of two stores, as shown in FIGS. 1 and 2*a*), or a shift-register (in the case of more than two stores, as shown in FIG. 2*b*). In the example shown in FIG. 1, an input of all the gates associated with the store 9′ is connected to the Q output, and an input of all the gates associated with the store 9″ is connected to the $\overline{Q}$ output of a bistable trigger stage 20 which is supplied by the multiplexer 3 with pulses at a frequency $f_1/6$. Thus with five successive pulses at the sampling frequency $f_1$ the decades of one store are successively sampled, and after a sixth pulse at the sampling frequency $f_1$ with the next five pulses at the sampling frequency the decades of the next store are sampled.

The sampled values from the stores are fed via lines (1), (2), (4) and (8) to the BCD input 7 of the comparator circuit 6. As illustrated in FIG. 1 the comparator circuit compares the stored values on the lines (1) and (8) and appearing at the input 7 with those of the BCD output 5 of the clock circuit 2. Identical circuits (not shown) are also provided for the lines (2) and (4). The outputs of the individual comparator circuits are taken to a gate $G_{20}$ whose output is connected to the input of a five-stage counter 21. This counter is advanced one step whenever coincidence occurs between the BCD clock signal and the sampled BCD store signal. When five coincidence situations have been detected in a store 9, i.e. a coincidence for each decade, the counter 21 applies an output signal to the output 13. If, during sampling of a store, one of the coincidences should be absent then the counter 21 does not produce any output signal. In order that the counter 21 can be reset to zero on completion of sampling of a store 9, a reset input of the counter 21 is connected to the digit driver output D6. This has the result that in each case with the sixth sampling pulse of frequency $f_1$ the counter 21 is reset to zero.

The output signal at the output 13 must be applied via an address logic circuit to the correct unit output. In FIG. 1 unit outputs 22′ and 22″ are assigned to the stores 9′ and 9″ respectively. Gates of the address logic circuit for the unit output 22′ are consequently connected to the $\overline{Q}$ output of the bistable stage 20, and gates for the unit output 22″ are connected to the Q output of the bistable stage 20. In this fashion a correct relationship between the store just sampled and the associated unit output is ensured. The unit outputs of the address logic circuit may be connected to further lines which transmit values for a process control.

In order to determine whether the switching function is to produce an on or off condition, one of the coding switches of the decade 19 in each store 9 is allotted to this function. Consequently, the line (8) of each store 9 is taken directly to a gate at the output 13. By means of this gate, a reversal of the sign of the output signal is produced when the coding switch of the store 9 just sampled and producing an output signal is closed.

Figures 3A, 3B:
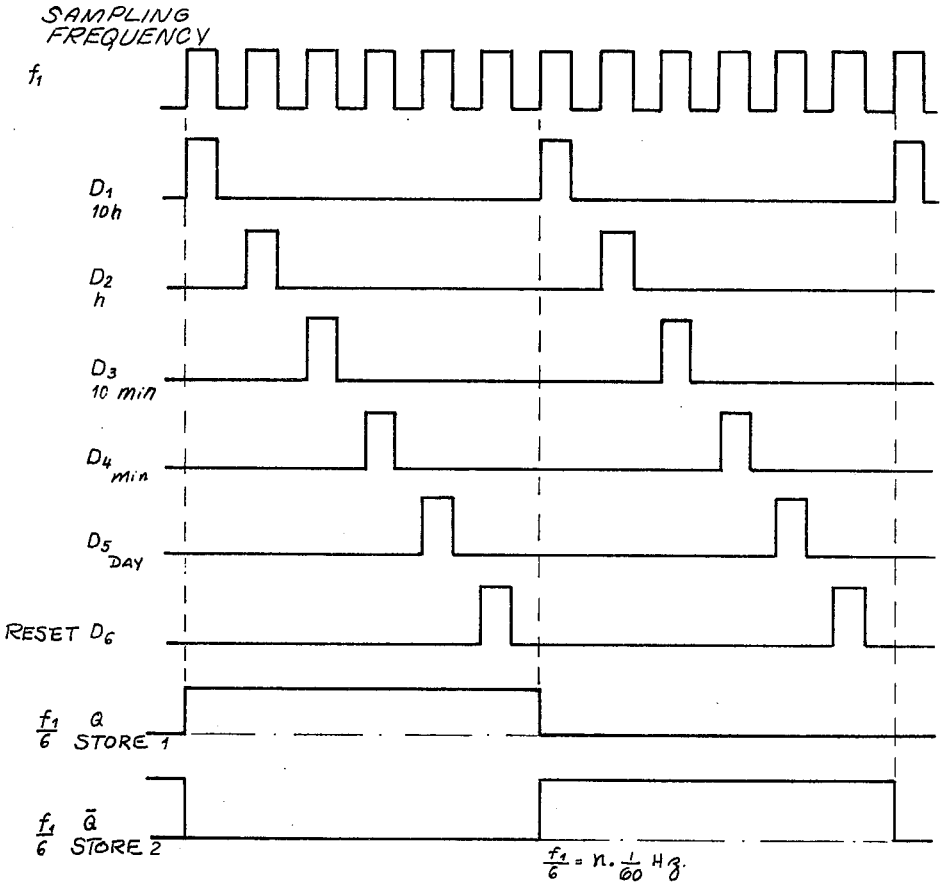

In order to code the days of the week the remaining three coding switches of the decade 19 in each store are used. Accordingly, in this respect coincidence need only be achieved in relation to the values on the lines (1), (2) and (4). If, however, a time value fed into a store is to perform a daily switching function, then in this case a by-pass circuit is provided which by-passes the comparator circuit 6. In accordance with the logic table for the fifth decade as shown in FIG. 3*b*, as shown in the first line of the table all three coding switches are open in respect of the daily switching condition. When sampling the fifth decade of a store 9, therefore, the zero-values are present on the associated lines (1), (2) and (4). These values are applied to an OR-gate which then arranges that the counter 21 is advanced one step, even if, via the comparator circuit 6, no coincidence signal is produced in respect of the fifth decade.

In the clock described above the most important electronic components are contained in an integrated circuit, which is defined in FIG. 1 by a box 29′ and which has at least 23 connections which have to be established outside the switching block.

It is possible to simplify the arrangement, and in particular to reduce the number of connections to the integrated circuit, as described below with reference to FIG. 5.

Figure 5:
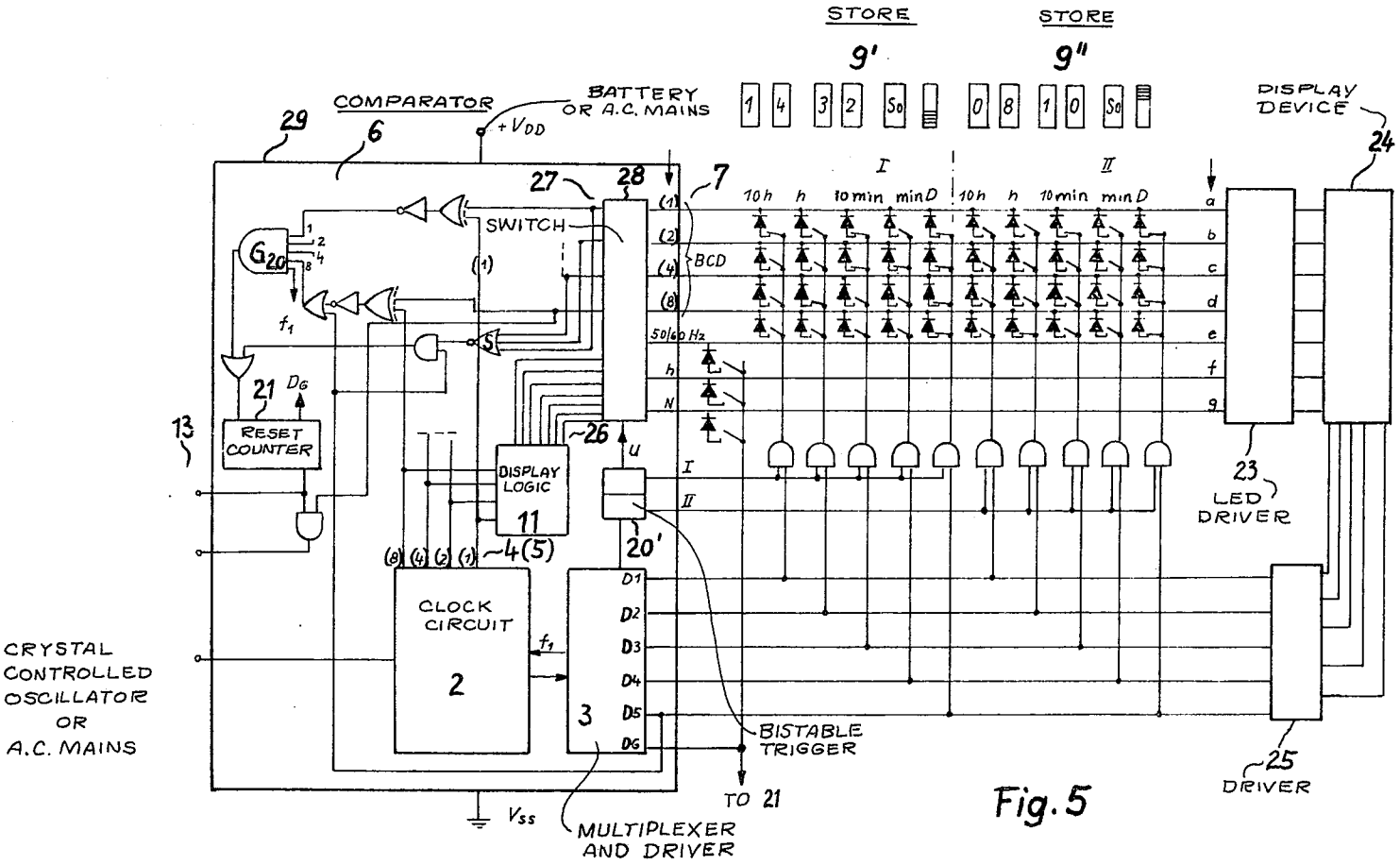
FIG. 5 shows a schematic circuit diagram of a clock in accordance with another embodiment of the invention.

In the circuit shown in FIG. 5 the clock circuit 2 has only one BCD output, referenced 4(5), instead of two. This BCD output is connected both to the display logic circuit 11 and to the comparator circuit 6. The seven outputs of the display logic circuit 11 are connected to a changeover switch 28 to which in turn the inputs 27 of the comparator circuit 6 are connected. Furthermore, seven lines extend away from the changeover switch 28.

Figure 6:
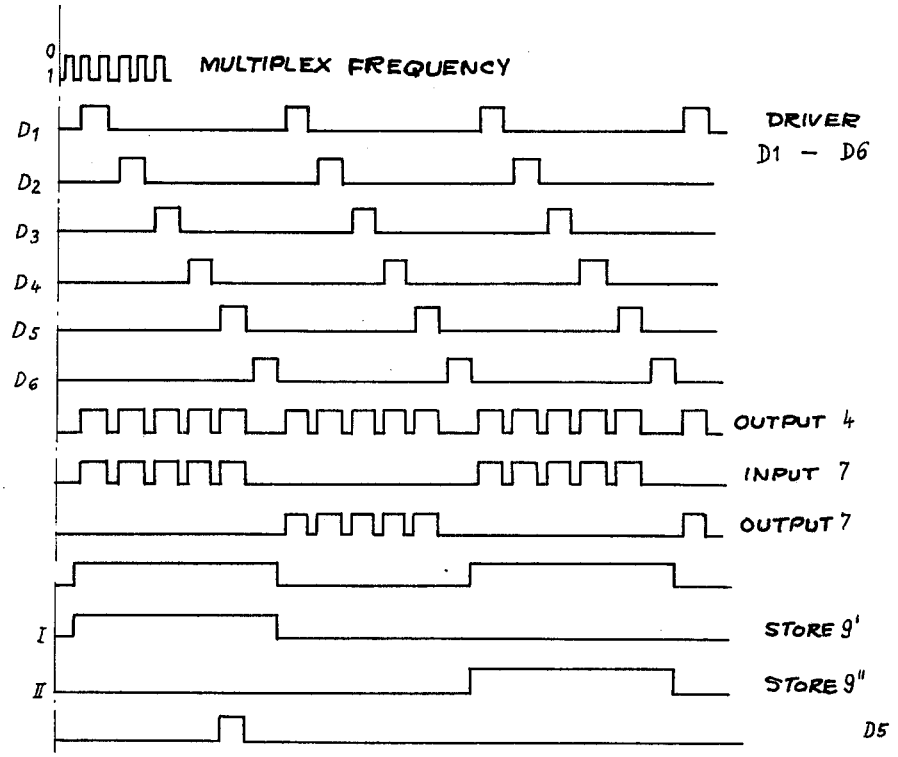
FIG. 6 illustrates signals which occur in operation of the clock shown in FIG. 5.

A bistable trigger stage 20′ has a modified switching sequence compared with that of the stage 20 of FIG. 1, as shown in FIG. 6. In each case after six pulses from the digit driver outputs $D_1$ to $D_6$, a switching unit signal U is applied to the changeover switch 28. Outputs I and II of the bistable stage 20′ are connected to the gates associated with the stores 9′ and 9″ respectively. During a first six sampling pulses from the digit driver, the switching signal U and the output I carry a high value.

Consequently, all the gates associated with the store 9' are enabled and at the same time in the changeover switch 28 the BCD inputs 7 which are marked (1), (2), (4) and (8) are connected to the inputs 27 of the comparator circuit 6. In this fashion, the store 9' is sampled. After the six sampling pulses have been produced, the switching signal U and the outputs I and II all have a low value. Sampling of the stores is consequently inhibited but in the changeover switch 28 the seven outputs 26 of the display logic circuit 11 are connected to the seven output lines of the change-over switch 28. These seven output lines are connected to a LED driver 23 which in turn drives a display device 24. Via a display driver 25 the display device 24 is furthermore supplied with five pulses from the digit driver, this having the result that the display device 24 is up-dated during these five pulses. After a sixth pulse from the digit driver the switching signal U again adopts a high value and at the same time the output II acquires a high value while the output I remains at the low value. During the next six sampling pulses, the gates associated with the store 9'' are driven and the BCD input 7 of the change-over switch 28 is connected to the input 27 of the comparator circuit 6. In this fashion, the store 9'' is sampled. After the sixth sampling pulse, once again the display logic circuit 11 is connected to the display device 24.

Thus, the operating sequence of this arrangement is: sampling of the stoe 9', application of signal to the display device 24, sampling of the store 9'', application of signal to the display device 24, etc.

As FIG. 5 clearly shows, four of the seven lines provided for the connections to the devices 23, 24, are employed simultaneously as BCD lines for the stores. The fifth line is required to choose the input frequency, e.g. 50 or 60 Hz. The remaining two lines perform minute and hour setting-up functions. The display device 24 is an opto-electronic device. The clock includes switching elements which serve to effect correctly timed setting up of the display device 24 and to erase or zero the display device and the clock circuit or parts thereof.

In many instances, with programmable clocks of this kind, it is unnecessary to have a frequently changing store program, the fixed-value stores instead having a program which need not be altered for long periods of time e.g. months or years. In such cases, each fixed value store can consist of a permanently wired circuit board which can be plugged in using a plug strip. The program can then be very quickly altered by exchanging the circuit boards.

Such circuit boards may be double-sided, i.e. printed on both sides, and may carry the entire circuitry for the stores 9, each of which as shown in FIGS. 1 and 5 comprises a matrix at each intersection point of which is provided a switch connected in series with a diode. In this case the conductors may be so routed initially all the switches are closed, and then for programming purposes it is simply necessary to interrupt lines which are to constitute open switches. This can for example be done by perforating the circuit board at a particular conductor. It is alternatively possible to use a printed circuit board which is printed on one side only. In this case initially all the switches may be open and closed switches may be established by soldering in wire bridges. It is also possible in this situation to use so-called wire-wrap pins. Naturally any other suitble form of store may be used.

What we claim as our invention and desire to secure by Letters Patent of the United States is:

1. An electronic digital clock having at least one time-programmed electrical output for triggering switching functions, the clock comprising a digital electrical time display, a clock circuit for producing and applying to said display coded signals representing time, a multiplexer, at least one coded fixed-value store, a sampling logic circuit and a comparator circuit, wherein coded values stored in the fixed-value store are sampled under the control of the multiplexer by the sampling logic circuit and are compared in the comparator circuit with said coded signals representing time, and wherein the event of coincidence between the sampled values and the coded signals representing time an output signal is produced at said time-programmed electrical output.

2. A clock as claimed in claim 1 and including a plurality of said fixed-value stores each of which is assigned a respective time-programmed electrical output for triggering switching functions, and further including an address circuit which successively connects the stores to the sampling logic circuit and an address logic circuit which is controlled by said address circuit to connect the respective time-programmed electrical outputs successively to the output of the comparator circuit.

3. A clock as claimed in claim 2 wherein each fixed value store comprises a plurality of decades each of which comprises a plurality of coding switches or codable switching elements.

4. A clock as claimed in claim 3 wherein the sampling logic circuit comprises a digit driver which is pulsed by the multiplexer in accordance with the pulsing of the display, which driver supplies pulses successively to the decades of the fixed-value stores and has at least as many stages as there are decades in each store.

5. A clock as claimed in claim 4 wherein the comparator circuit has two BCD inputs, one of which is connected to a BCD output of the clock circuit and the other to a BDC output of the stores, the clock further including a counter provided at the output of the comparator circuit and having a number of counting stages equivalent ot the number of decades in each store.

6. A clock as claimed in claim 5 wherein the digit driver has one stage more than each store has decades, and wherein the last stage of the digit driver is connected to reset input of the counter.

7. A clock as claimed in claim 6 wherein the address circuit is pulsed by the multiplexer at a frequency which is equal to the frequency supplied to the digit driver divided by the number of stages of the digit driver.

8. A clock as claimed in claim 5 wherein one of the decades of each store comprises three coding switches which serve to determine days of the week.

9. A clock as claimed in claim 8 wherein said one of the decades of each store comprises a further coding switch which serves to determine as on or off switching function.

10. A clock as claimed in claim 8 and including a logic unit which is responsive to said three coding switches all being open to advance the counter by one step.

11. A clock as claimed in claim 2 wherein there are two stores and wherein the address circuit consists of a bistable trigger stage.

12. A clock as claimed in claim 2 wherein there are more than two stores and wherein the address circuit consists of a shift-register.

13. A clock as claimed in claim 3 wherein the fixed-value stores are constituted by coding switches with number reels or discs.

14. A clock as claimed in claim 3 wherein the fixed-value stores have storage elements comprising data carriers of current type or tape type.

15. A clock as claimed in claim 14 wherein the data carriers are perforated.

16. A clock a claimed in claim 1 and including a crystal-controlled oscillator the output of which is connected to the clock circuit.

17. A clock as claimed in claim 1 wherein the clock circuit is responsive to the AC mains frequency.

18. A claim as claimed in claim 16 and arranged to be battery-powered.

19. A clock as claimed in claim 17 and arranged to be powered from the AC mains.

20. A clock as claimed in claim 1 wherein the display comprises an opto-electronic display device, and wherein the clock further includes switching elements which serve to effect correctly timed setting up of the display device and to erase or zero the display device and the clock circuit or parts thereof.

21. A clock as claimed in claim 1 and arranged to operate as a master clock with an external display device and setting up means.

22. A clock as claimed in claim 4 wherein outputs of the address logic circuit are connected to further lines which transmit limiting values for a process control.

23. A clock as claimed in claim 1 and including a change-over switch to which the outputs of the clock circuit and the inputs of the comparator circuit to which are also connected the input lines of the time display, at least some of which lines are simultaneously connected to the outputs of the fixed-value store, and wherein during a first cycle of operation of the sampling logic circuit the outputs of the fixed-value store are connected to the inputs of the comparator circuit and during a second such cycle the outputs of the clock circuit are connected to the input lines of the time display.

24. A clock as claimed in claim 23 and including a plurality of said fixed-value stores and further including an address circuit which after each cycle of operation of the sampling logic circuit supplies a switching signal to the changeover switch, and wherein the changeover switch is responsive to the switching signal following alternate cycles to connect the outputs of the clock circuit to the input lines of the time display device and is responsive to the switching signal following intervening cycles in each case to connect a successive one of the stores to the sampling logic circuit.

25. A clock as claimed in claim 24 wherein the sampling logic circuit comprises a digit driver which is pulsed by the multiplexer and successively and in stepped fashing switches decades of the fixed-value stores and driver inputs of the time display.

26. A clock as claimed in claim 25 wherein the comparator circuit has two BCD inputs one of which is connected to a BCD output of the clock circuit and the other to a BCD output of the changeover switch, the clock further including a counter provided at the output of the comparator circuit and having a number of counting stages equivalent to the number of decades in each store.

27. A clock as claimed in claim 26 wherein the digit driver has one stage more than each store has decades, and wherein the last stage of the digit driver is connected to a reset input of the counter.

28. A clock as claimed in claim 27 wherein the address circuit and the changeover switch are pulsed by the multiplexer at a frequency which is equal to the frequency supplied to the digit driver divided by the number of stages of the digit driver.

29. a clock as claimed in claim 28 wherein the digit driver has five outputs which are used to drive minutes, tens of minutes, hours, tens of hours, and days of the week displays, and also to drive the fixed-value stores.

30. A clock as claimed in claim 23 wherein the fixed-value store consists of a permanently wired printed circuit board.

31. A clock as claimed in claim 30 wherein the store comprises switches which are formed by conductor paths in which an open switch is formed by perforating the circuit board at the location of the conductor path.

32. A clock as claimed in claim 30 wherein the store comprises switches which are constituted by interrupted-conductor paths in which a closed switch is formed by a wire-wrapped line connection.

* * * * *